US010123126B2

(12) United States Patent
Margalit

(10) Patent No.: US 10,123,126 B2
(45) Date of Patent: Nov. 6, 2018

(54) MEMS-BASED AUDIO SPEAKER SYSTEM USING SINGLE SIDEBAND MODULATION

(71) Applicant: EMPIRE TECHNOLOGY DEVELOPMENT LLC, Wilmington, DE (US)

(72) Inventor: Mordehai Margalit, Zichron Yaaqov (IL)

(73) Assignee: Empire Technology Development LLC, Wilmington, DE (US)

( * ) Notice: Subject to any disclaimer, the term of this patent is extended or adjusted under 35 U.S.C. 154(b) by 94 days.

(21) Appl. No.: 15/114,411

(22) PCT Filed: Feb. 8, 2014

(86) PCT No.: PCT/US2014/015440
§ 371 (c)(1),
(2) Date: Jul. 27, 2016

(87) PCT Pub. No.: WO2015/119628
PCT Pub. Date: Aug. 13, 2015

(65) Prior Publication Data

US 2016/0345104 A1 Nov. 24, 2016

(51) Int. Cl.
*H04R 25/00* (2006.01)
*H04R 17/00* (2006.01)
(Continued)

(52) U.S. Cl.
CPC ..... *H04R 17/005* (2013.01); *H04R 1/24* (2013.01); *H04R 1/345* (2013.01); *H04R 1/403* (2013.01);
(Continued)

(58) Field of Classification Search
CPC ..... H04R 17/005; H04R 1/24; H04R 1/345; H04R 1/403; H04R 17/00; H04R 19/02;
(Continued)

(56) References Cited

U.S. PATENT DOCUMENTS 3,939,467 A 2/1976 Cook et al.
5,889,870 A 3/1999 Norris
(Continued)

FOREIGN PATENT DOCUMENTS

EP 1737266 A1 12/2006
EP 2271129 A1 1/2011
(Continued)

OTHER PUBLICATIONS

Feiertag, G., et al.,"Determining the acoustic resistance of small sound holes for MEMS microphones." Procedia Engineering, vol. 25, pp. 1509-1512 (2011).
(Continued)

*Primary Examiner* — Sean H Nguyen

(57) ABSTRACT

Techniques described herein generally include methods and systems related to a MEMS-based audio speaker system configured with multiple speaker devices to generate an audio signal that is substantially without a high-band ultrasonic signal. Energy may be transferred to a low frequency sideband of the audio signal output and substantially eliminated from the high frequency sideband of the audio signal by passing an acoustic carrier signal through two different modulators. One modulator may implement a first modulation function on the acoustic carrier signal to generate a first audio signal, where the first modulation function may be based on a target acoustic output signal for the MEMS-based audio speaker system. The second modulator may implement a second modulation function on the acoustic carrier signal to generate a second audio signal, where the second audio signal may be the Hilbert transform of the first audio signal.

26 Claims, 8 Drawing Sheets

(51) Int. Cl.

| | |
|---|---|
| ***H04R 1/24*** | (2006.01) |
| ***H04R 1/34*** | (2006.01) |
| ***H04R 1/40*** | (2006.01) |
| *H04R 19/02* | (2006.01) |

(52) U.S. Cl.
CPC ..... *H04R 17/00* (2013.01); *H04R 19/02* (2013.01); *H04R 2201/003* (2013.01); *H04R 2201/401* (2013.01); *H04R 2217/03* (2013.01)

(58) Field of Classification Search
CPC ..... H04R 2201/003; H04R 2201/401; H04R 2217/03
USPC ..... 381/190
See application file for complete search history.

(56) References Cited

U.S. PATENT DOCUMENTS

| | | | | |
|---|---|---|---|---|
| 6,315,462 | B1 | 11/2001 | Anthamatten et al. | |
| 6,388,359 | B1 | 5/2002 | Duelli et al. | |
| 6,584,205 | B1 * | 6/2003 | Croft, III | H04R 3/00 381/103 |
| 6,606,389 | B1 | 8/2003 | Selfridge et al. | |
| 6,612,029 | B2 | 9/2003 | Behin et al. | |
| 6,619,813 | B1 * | 9/2003 | Schnell | A44B 15/005 362/116 |
| 6,631,196 | B1 * | 10/2003 | Taenzer | H04B 1/04 381/312 |
| 6,678,381 | B1 | 1/2004 | Manabe | |
| 6,771,001 | B2 | 8/2004 | Mao et al. | |
| 6,778,672 | B2 | 8/2004 | Breed et al. | |
| 6,925,187 | B2 | 8/2005 | Norris et al. | |
| 7,502,486 | B2 | 3/2009 | Shin et al. | |
| 7,747,029 | B2 | 6/2010 | Kim et al. | |
| 7,881,489 | B2 | 2/2011 | Matsuzawa et al. | |
| 7,945,059 | B2 | 5/2011 | Miyazaki | |
| 7,961,900 | B2 | 6/2011 | Zurek et al. | |
| 8,079,246 | B2 | 12/2011 | Garmire et al. | |
| 8,428,278 | B2 | 4/2013 | Lastrucci | |
| 2001/0034938 | A1 | 11/2001 | Behin et al. | |
| 2006/0094988 | A1 | 5/2006 | Tosaya et al. | |
| 2006/0291667 | A1 | 12/2006 | Watanabe et al. | |
| 2007/0050441 | A1 * | 3/2007 | Taenzer | H04R 3/005 708/446 |
| 2008/0013761 | A1 | 1/2008 | Matsuzawa et al. | |
| 2008/0205195 | A1 | 8/2008 | Van Der Merwe | |
| 2008/0226096 | A1 | 9/2008 | Waddell et al. | |
| 2008/0267431 | A1 | 10/2008 | Leidl et al. | |
| 2008/0285777 | A1 | 11/2008 | Pompei | |
| 2009/0152980 | A1 | 6/2009 | Huang | |
| 2010/0080409 | A1 | 4/2010 | Xu et al. | |
| 2010/0098274 | A1 * | 4/2010 | Hannemann | H04R 1/403 381/300 |
| 2010/0264777 | A1 | 10/2010 | Medhat et al. | |
| 2010/0289717 | A1 | 11/2010 | Arslan et al. | |
| 2011/0115337 | A1 | 5/2011 | Nakamura et al. | |
| 2011/0122731 | A1 | 5/2011 | Buccafusca et al. | |
| 2011/0123043 | A1 | 5/2011 | Felberer et al. | |
| 2011/0182150 | A1 | 7/2011 | Cohen et al. | |
| 2012/0014525 | A1 | 1/2012 | Ko et al. | |
| 2012/0017693 | A1 | 1/2012 | Robert et al. | |
| 2012/0177237 | A1 | 7/2012 | Shukla et al. | |
| 2012/0294450 | A1 | 11/2012 | Ozcan | |
| 2013/0044904 | A1 | 2/2013 | Margalit | |
| 2013/0121500 | A1 * | 5/2013 | Lamb | H04R 3/04 381/71.1 |
| 2013/0121509 | A1 | 5/2013 | Hsu et al. | |
| 2013/0202119 | A1 | 8/2013 | Thiede | |

FOREIGN PATENT DOCUMENTS

| | | | |
|---|---|---|---|
| EP | 2381289 | A1 | 10/2011 |
| JP | S6262700 | A | 3/1987 |
| JP | 2004349815 | A | 12/2004 |
| JP | 2004363967 | A | 12/2004 |
| JP | 2005184365 | A | 7/2005 |
| JP | 2005354582 | A | 12/2005 |
| JP | 2007005872 | A | 1/2007 |
| JP | 2007124449 | A | 5/2007 |
| JP | 2007312019 | A | 11/2007 |
| JP | 2008048312 | A | 2/2008 |
| JP | 2008182583 | A | 8/2008 |
| JP | 2012216898 | A | 11/2012 |
| KR | 1020050054648 | A | 6/2005 |
| WO | 9812589 | A1 | 3/1998 |
| WO | 173934 | A2 | 10/2001 |

OTHER PUBLICATIONS

"Capacitive Micromachined Ultrasonic Transducers (CMUTs)", Retrieved on Apr. 4, 2016 from the Internet at <URL: https://web.archive.org/web/20120126104159/http://www.me.gatech.edu/mist/cmut.htm>, pp. 4.

"Discover the Remarkable Novel Way to Transmit Sound", Retrieved on Mar. 28, 2016 from the Internet at <URL: https://web.archive.org/web/20120911234401/http://www.parametricsound.com/Technology.php>, pp. 4.

"Electrostatic Loudspeaker", Retrieved on Apr. 4, 2016 from the Internet at <URL:https://web.archive.org/web/20130828183848/http://en.wikipedia.org/wiki/Electrostatic_loudspeaker>, last modified on Feb. 27, 2013, pp. 6.

"First Major Innovation in Audio Speakers in Nearly 80 Years!", Audio Pixels Limited, Retrieved on Apr. 4, 2016 from the Internet at <URL:https://web.archive.org/web/20140125163627/http://www.audiopixels.com.au/index.cfm/technology/>, pp. 3.

"Hilbert Transform", Wikipedia, Retrieved on Mar. 28, 2016 from the Internet at <URL:https://web.archive.org/web/20131205110139/http://en.wikipedia.org/wiki/Hilbert_transform>, last modified on Dec. 4, 2013, pp. 17.

"ICsense Designs Asic for World's First Mems Speaker—Audio Pixels Limited and Icsense Enter Strategic Engagement to Support Production of Digital Mems Based Speaker Chip", Retrieved on Nov. 6, 2014 from the Internet at <URL:http://www.icsense.com/NEWS%3A%20Audiopixels>, posted on Oct. 9, 2013, pp. 2.

"Investor Video Presentation", Audio pixel Limited, Retrieved on Nov. 10, 2014 from the Internet at <URL:http://www.audiopixels.com.au/index.cfm/investor/video-presentation/>.

"Microelectromechanical Systems", Wikipedia, Retrieved on Apr. 4, 2016 from the Internet at <URL:https://web.archive.org/web/20131226230521/http://en.wikipedia.org/wiki/Microelectromechanical_systems>, last modified on Nov. 28, 2013, pp. 12.

"Single-sideband Modulation," Retrieved on Mar. 28, 2016 from the Internet at <URL:https://web.archive.org/web/20131217204859/http://en.wikipedia.org/wiki/Single-sideband_modulation>, last modified on Nov. 12, 2013, pp. 9.

"Sound from Ultrasound", Wikipedia, Retrieved on Mar. 28, 2016 from the Internet at <URL: https://web.archive.org/web/20130829134301/http:/en.wikipedia.org/wiki/Sound_from_ultrasound>, last modified on Jun. 27, 2013, pp. 10.

Rick Daniell, "Digital Loudspeakers—Part 1", YouTube, Retrieved on Nov. 7, 2014 from the Internet at <URL: https://www.youtube.com/watch?v=VgeUUMvdPeI>, Published on Apr. 29, 2012, pp. 2.

Brett M. Diamond, "Digital Sound Reconstruction Using Arrays of CMOS-MEMS Microspeakers", Electrical and Computer Engineering, 2002, pp. 1-60.

Extended European Search Report for European Patent Application No. 11870957.5 (PCT/US2011/04783), dated Apr. 14, 2015.

Extended European Search Report for European Patent Application No. 15200544.3, dated Feb. 19, 2016.

International Search Report and Written Opinion of the International Searching Authority, International application No. PCT/US2011/047833, dated Nov. 28, 2011.

International Search Report and Written Opinion of the International Searching Authority, International application No. PCT/US2014/015438, dated Nov. 7, 2014.

(56) References Cited

OTHER PUBLICATIONS

International Search Report and Written Opinion of the International Searching Authority, International application No. PCT/US2014/015439, dated Oct. 29, 2015.
International Search Report and Written Opinion of the International Searching Authority, International application No. PCT/US2014/015440, dated Oct. 27, 2015.
International Search Report and Written Opinion of the International Searching Authority, International application No. PCT/US2014/015441, dated Oct. 29, 2015.
Eino Jakku et al., "The Theory of Electrostatic Forces in a Thin Electret (MEMS) Speaker", Proceedings IMAPS Nordic 2008 Helsingor, Sep. 14-16, 2008, pp. 95-100.
Brian D. Jensen et al., "Shaped Comb Fingers for Tailored Electromechanical Restoring Force", Journal of Microelectromechanical Systems, Jun. 25, 2003, pp. 373-383, vol. 12, No. 3.
Anatol Khilo et al., "Broadband Linearized Silicon Modulator", Optics Express, Feb. 23, 2011, pp. 4485-4500, vol. 19, No. 5.
Rob Legtenberg et al., "Comb-Drive Actuators for Large Displacements", Journal of Micromechanics and Microengineering, 1996, pp. 320-329, vol. 6.
Isaac Leung, "Sony to Help Develop Next-generation MEMS-based Speakers", Retrieved on Apr. 4, 2016 from the Internet at <URL: https://web.archive.org/web/20120327134931/http://www.electronicsnews.com.au/features/sony-to-help-develop-next-generation-mems-based-sp>, posted on Jul. 8, 2011, pp. 2.
Nguyen, C., "MEMS Comb-Drive Actuators", Microfabrication Technology, 2010, pp. 3.
M. Olfatnia et al., "Note: An Asymmetric Flexure Mechanism for Comb-Drive Actuators", Review of Scientific Instruments, 2012, pp. 116105-1-116105-3, vol. 83, Issue 11.
Mohammad Olfatnia et al., "Large Stroke Electrostatic Comb-Drive Actuators Enabled by a Novel Flexure Mechanism", Journal of Microelectromechanical Systems, Apr. 2013, pp. 483-494, vol. 22, No. 2.
Alexander A Trusov et al., "Capacitive Detection in Resonant MEMS with Arbitrary Amplitude of Motion", Journal of Micromechanics and Microengineering, Aug. 2007, pp. 1583-1592, vol. 17.
Tristan T. Trutna et al., "An Enhanced Stability Model for Electrostatic Comb-Drive Actuator Design", Proceedings of the ASME 2010 International Design Engineering Technical Conferences & Computers and Information in Engineering Conference IDETC/CIE, Aug. 15-18, 2010.
Wenjing Ye et al., "Optimal Shape Design of an Electrostatic Comb Drive in Microelectromechanical Systems", Journal of Microelectromechanical Systems, Mar. 1998, pp. 16-26, vol. 7, No. 1.
Masahide Yoneyama et al., "The Audio Spotlight: An Application of Nonlinear Interaction of Sound Waves to a New Type of Loudspeaker Design", Journal of the Acoustical Society of America, May 1983, pp. 1532-1536, vol. 73, No. 5.

* cited by examiner

MEMS-BASED AUDIO SPEAKER SYSTEM USING SINGLE SIDEBAND MODULATION

CROSS-REFERENCE TO RELATED APPLICATION

The present application is a U.S. national stage filing under 35 U.S.C. S 371 of International Application No. PCT/US2014/015440, filed on Feb. 8, 2014 and entitled "MEMS-BASED AUDIO SPEAKER SYSTEM USING SINGLE SIDEBAND MODULATION." International Application No. PCT/US2014/015440, including any appendices or attachments thereof, is hereby incorporated by reference in its entirety.

BACKGROUND

Unless otherwise indicated herein, the approaches described in this section are not prior art to the claims in this application and are not admitted to be prior art by inclusion in this section.

Microelectromechanical systems, or MEMS, is a technology that includes miniaturized mechanical and electromechanical elements, devices, and structures that may be produced using batch micro-fabrication or micro-machining techniques associated with the integrated circuit industry. The various physical dimensions of MEMS devices can vary greatly, for example from well below one micron to as large as the millimeter scale. In addition, there may be a wide range of different types of MEMS devices, from relatively simple structures having no moving elements, to extremely complex electromechanical systems with multiple moving elements under the control of integrated microelectronics. Such devices may include microsensors, microactuators, and microelectronics. Microsensors and microactuators may be categorized as "transducers," which are devices that may convert energy from one form to another. In the case of microactuators, a MEMS device may typically convert an electrical signal into some form of mechanical actuation.

SUMMARY

In accordance with at least some embodiments of the present disclosure, a speaker apparatus that comprises a first speaker device and a second speaker device is disclosed. The first speaker device comprises a first oscillation element configured to generate a first ultrasonic acoustic signal along a first directional path and a second oscillation element configured to modulate the first ultrasonic acoustic signal such that a first acoustic signal is generated. The second speaker device comprises a third oscillation element configured to generate a second ultrasonic acoustic signal along the first directional path and a fourth oscillation element configured to modulate the second ultrasonic acoustic signal such that a second acoustic signal is generated that is a linear derivation of the first acoustic signal and is a different acoustic signal than the first acoustic signal. The first speaker device and the second speaker device are each contained in a volume with at least one dimension smaller than a wavelength of the first ultrasonic acoustic signal.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. These drawings depict only several embodiments in accordance with the disclosure and are, therefore, not to be considered limiting of its scope. The disclosure will be described with additional specificity and detail through use of the accompanying drawings.

DETAILED DESCRIPTION

Figure 1:
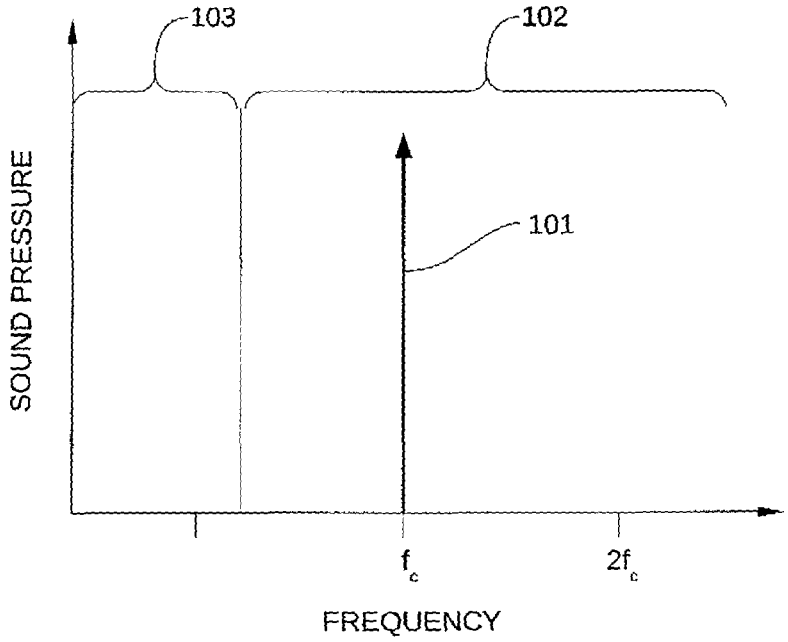
FIG. 1 schematically illustrates an example ultrasonic signal generated by a MEMS-based audio speaker system.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. The aspects of the disclosure, as generally described herein, and illustrated in the Figures, can be arranged, substituted, combined, and designed in a wide variety of different configurations, all of which are explicitly contemplated and made part of this disclosure.

Microelectromechanical systems (MEMS) technology is used for a wide variety of miniaturized mechanical and electro-mechanical devices. However, the small size of MEMS devices has mostly precluded the use of MEMS technology for audio speaker applications, since the frequency of sound emitted by a micron-scale oscillating membrane is generally in the ultrasonic regime. Some MEMS acoustic modulators may be used to create audio signals from a high frequency acoustic source, such as a MEMS-based audio speaker system. Specifically, a desired audible audio signal may be created by generating an ultrasonic signal with a MEMS oscillating membrane or a piezoelectric transducer, and then modulating the ultrasonic signal with an acoustic modulator, such as a MEMS shutter element. Because the ultrasonic signal may act as an acoustic carrier wave and the acoustic modulator may superimpose an input signal thereon by modulating the ultrasonic signal, the resultant signal generated by the MEMS-based audio speaker system may be a function of the frequency difference between the ultrasonic signal and the input signal. In this way, acoustic signals can be generated by a MEMS-based audio speaker system in the audible range and as low as the sub-100 Hz range, despite the very small size of such a speaker system.

Figure 2:
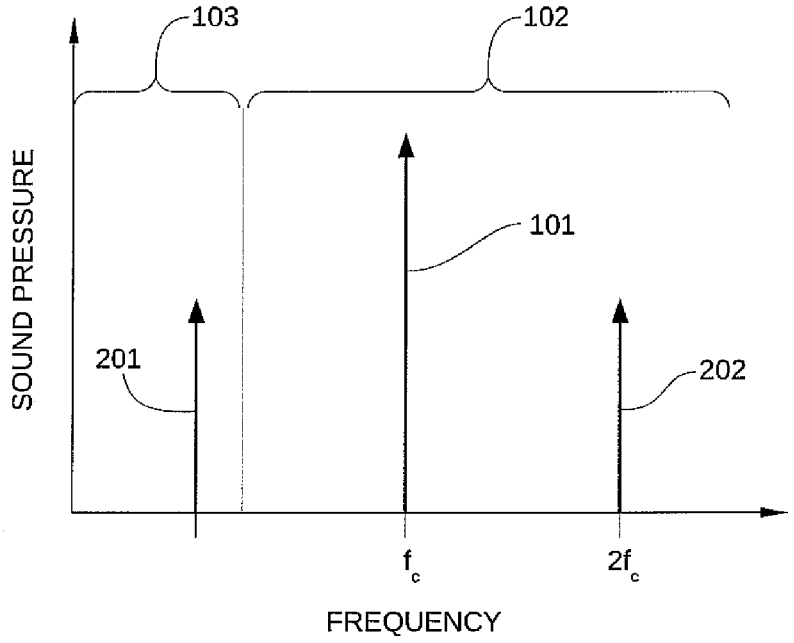
FIG. 2 schematically illustrates examples of a low frequency modulated sideband and a high frequency modulated sideband, which may be generated when the ultrasonic signal of FIG. 1 is amplitude modulated with an acoustic modulator in the MEMS-based audio speaker system.

FIG. 1 schematically illustrates an example ultrasonic signal 101 generated by the above-described MEMS-based audio speaker system. As shown, ultrasonic signal 101 may be located at the carrier frequency $f_C$ in the ultrasound region 102 of the sound frequency spectrum, and not in the audible region 103 of the sound frequency spectrum. The audible region 103 may generally include the range of human hearing, extending from about 20 Hz to about 20 kHz, and the ultrasound region 102 may include some or all frequencies higher than about 20 kHz. FIG. 2 schematically illustrates examples of a low frequency modulated sideband 201 and high frequency modulated sideband 202, which may be generated when ultrasonic signal 101 is amplitude modulated with an acoustic modulator in the above-described MEMS-based audio speaker system. Low frequency modulated sideband 201 and high frequency modulated sideband 202 may be harmonic signals that are a function of the modulating frequency, which for example may be the frequency of modulation of the MEMS shutter element or other acoustic modulator of the MEMS-based audio speaker system. Low frequency modulated sideband 201 may be located in audible region 103, and may represent an audible output signal from the MEMS-based audio speaker system. In contrast, high frequency modulated sideband 202 may be located in ultrasound region 102 and therefore may not be audible. Because such a method of amplitude modulation creates the two sidebands (low frequency modulated sideband 201 and high frequency modulated sideband 202), and because one of these sidebands is in ultrasound region 102, only about half of the sound generated by such a MEMS-based audio speaker system may be audible. Thus, the maximum efficiency of this audio speaker system may be at best 50%, since no more than 50% of the sound being generated may be inaudible.

In light of the issues described above with some MEMS-based audio speaker systems, this disclosure is generally drawn, inter alia, to methods, apparatus, systems, and devices, related to MEMS devices.

Briefly stated, a MEMS-based audio speaker system according to embodiments of the present disclosure, may be configured with multiple speaker devices that modulate an ultrasonic signal to generate a target audio signal that is substantially without a high-band ultrasonic signal, such as high frequency modulated sideband 202 in FIG. 2. Thus, when generating the target audio signal, very little or no sound energy generated by the MEMS-based audio speaker system is located in an ultrasonic audio sideband. Stated in another way, the acoustic equivalent of a single sideband modulation scheme may be used to increase the efficiency of a MEMS-based audio speaker system. Specifically, energy may be transferred to the low frequency sideband and substantially eliminated from the high frequency sideband by splitting an acoustic carrier signal into two carrier signals and passing each of these carrier signals through a different modulator. One modulator may implement a first modulation function on the acoustic carrier signal to generate a first acoustic signal, where the first modulation function may be based on a target acoustic output signal for the MEMS-based audio speaker system. The second modulator may implement a second modulation function on the acoustic carrier signal to generate a second acoustic signal, where the second acoustic signal may be the Hilbert transform of the first acoustic signal. The combination of the first acoustic signal and the second acoustic signal in the transport medium (e.g., air) produces a resultant acoustic signal that may be substantially without a high-band ultrasonic signal.

Figure 3:
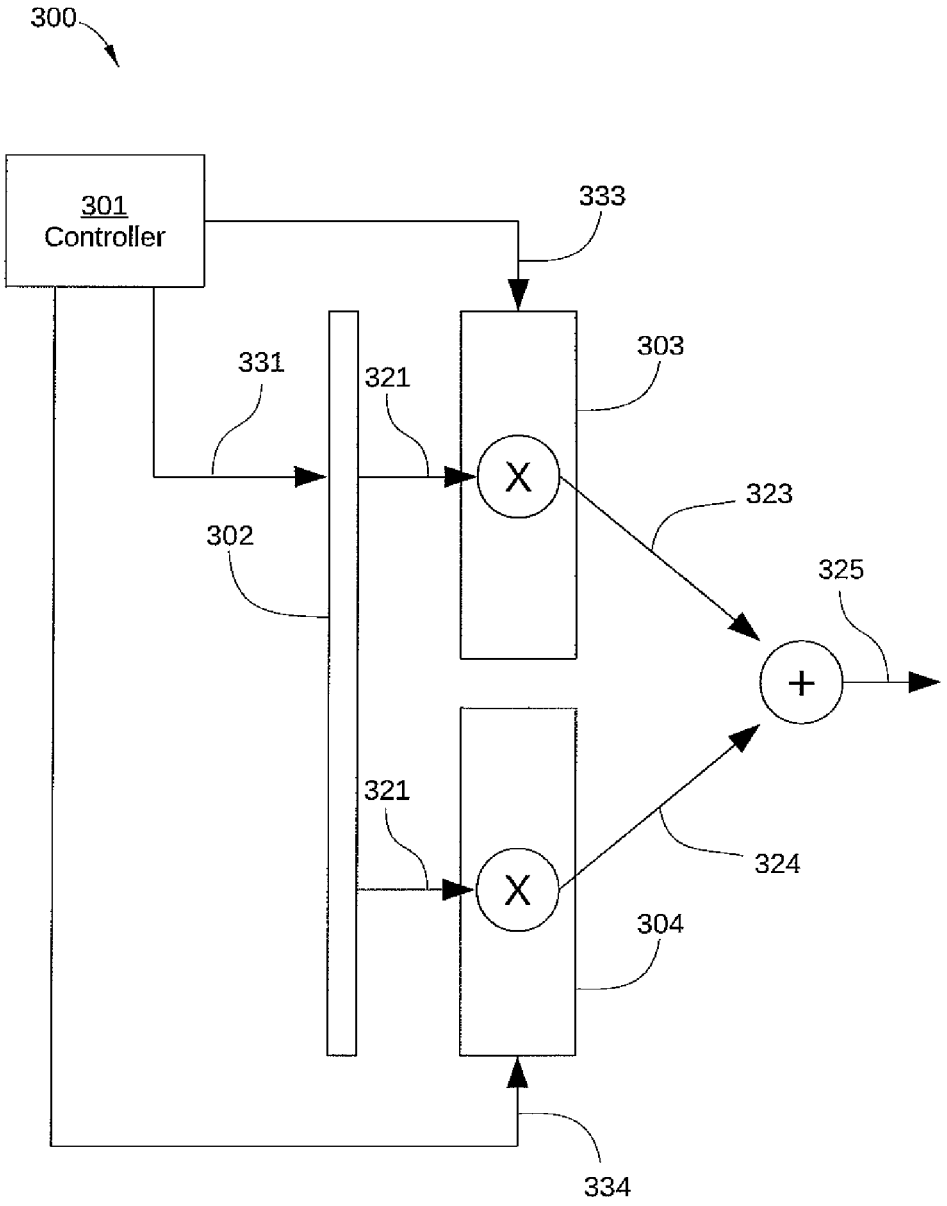
FIG. 3 is a block diagram illustrating a MEMS-based audio speaker system, also referred to as a pico speaker system.

FIG. 3 is a block diagram illustrating a MEMS-based audio speaker system, also referred to as a pico speaker system 300, arranged in accordance with at least some embodiments of the present disclosure. Pico speaker system 300 may be a compact, energy-efficient acoustic generator capable of producing acoustic signals throughout the audible portion of the sound frequency spectrum, for example from the sub-100 Hz range to 20 kHz and above. As such, pico speaker system 300 may be well-suited for mobile devices and/or any other applications in which size, sound fidelity, or energy efficiency are beneficial.

Pico speaker system 300 may include a controller 301, an oscillation membrane 302, a first MEMS shutter 303, and a second MEMS shutter 304, arranged as shown. In some embodiments, oscillation membrane 302, first MEMS shutter 303, and second MEMS shutter 304 may be configured as part of a single MEMS structure, where oscillation membrane 301 may be formed from a layer or thin film on a substrate and first MEMS shutter 303 and second MEMS shutter 304 may be formed from a different layer or thin film on the substrate. In other embodiments, first MEMS shutter 303 and second MEMS shutter 304 may be formed from a layer or thin film on a MEMS substrate and oscillation membrane 302 may be a separately fabricated device that is coupled to the MEMS substrate. Other configurations of MEMS shutters and oscillation membranes arranged in a pico speaker system may also fall within the scope of the present disclosure.

Controller 301 may be configured to control the various active elements of pico speaker system 300 so that a resultant acoustic signal 325 is produced by pico speaker system 300 that is substantially similar to a target audio output. For example, controller 301 may be configured to generate and supply oscillation signal 331 (which oscillates) to oscillation membrane 302 so that oscillation membrane 302 may generate an ultrasonic acoustic carrier signal 321. Controller 301 may also be configured to generate and supply a first modulation signal 333 to first MEMS shutter 303 and a second modulation signal 334 to second MEMS shutter 304. First modulation signal 333 and second modulation signal 334 are described in greater detail below. Controller 301 may include logical circuitry incorporated in pico speaker system 300 and/or a logic chip or other circuitry that is located remotely from pico speaker system 300. Alternatively or additionally, some or all operations of controller 301 may be performed by a software construct or module that is loaded into such circuitry or is executed by one or more processor devices associated with pico speaker system 300. In some embodiments, the logic circuitry of controller 301 may be fabricated in the MEMS substrate from which first MEMS shutter 303 and second MEMS shutter 304 may be formed.

Oscillation membrane 302 may be any technically feasible device configured to oscillate and generate ultrasonic acoustic carrier signal 321, where ultrasonic acoustic carrier signal 321 may be an ultrasonic acoustic signal of a fixed frequency. In some embodiments, ultrasonic acoustic carrier signal 321 may have a fixed frequency of at least about 50 kHz, for example. In some embodiments, ultrasonic acoustic carrier signal 321 may have a fixed frequency that is significantly higher than 50 kHz, for example 100 kHz or more. Furthermore, in some embodiments, oscillation membrane 302 may have a very small form factor, for example on the order of 10s or 100s of microns. Consequently, in some embodiments, oscillation membrane 302 may be a MEMS oscillation membrane formed from a layer or thin film disposed on a MEMS substrate and micro-machined accordingly. Thus, oscillation membrane 302 may be substantially stationary with respect to adjacent elements of pico speaker system 300, e.g., having one, some, or all edges anchored to adjacent elements of pico speaker system 300. In such embodiments, a target oscillation may be induced in oscillation membrane 302 via any suitable electrostatic MEMS actuation scheme. Alternatively, oscillation membrane 302 may be a piezoelectric transducer configured to generate ultrasonic acoustic carrier signal 321. In either case, oscillation membrane 302 may be oriented so that ultrasonic acoustic carrier signal 321 is directed toward first MEMS shutter 303 and second MEMS shutter 304, as shown in FIG. 3.

First MEMS shutter 303 and second MEMS shutter 304 may be micro-machined shutter elements that are each configured to independently modulate ultrasonic acoustic carrier signal 321. For example, first MEMS shutter 303 may be configured to modulate ultrasonic acoustic carrier signal 321 according to first modulation signal 333 to generate acoustic signal 323. Thus, as indicated in FIG. 3, first MEMS shutter 303 may multiply ultrasonic acoustic carrier signal 321, which may be a sinusoidal function, by first modulation signal 333, which may also be a sinusoidal function. The result of such a multiplication is a sum of frequencies and a difference of frequencies, where the sum of frequencies corresponds to twice the modulation signal (for example high frequency modulated sideband 202 in FIG. 2) and the difference of frequencies corresponds to the audible acoustic signal (for example low frequency modulated sideband 201 in FIG. 2). Similarly, second modulation signal 334 may be configured to modulate ultrasonic acoustic carrier signal 321 according to second modulation signal 334 to generate acoustic signal 324. According to embodiments of the present disclosure, acoustic signal 323 and acoustic signal 324 may be selected so that when combined, a resultant acoustic signal 325 is produced that is 1) substantially similar to a target audio output by pico speaker system 300 and 2) substantially without a high-band ultrasonic signal. This may be accomplished by generating acoustic signal 324 with a high frequency modulated sideband that may be substantially equal to that contained in acoustic signal 323 but shifted in phase by 180°. In this way, the combination of acoustic signal 323 and acoustic signal 324 may cancel the high frequency modulated sideband contained in each. Determination of appropriate first modulation signal 333 and second modulation signal 334 so that the combination of acoustic signal 323 and acoustic signal 324 produces a resultant acoustic signal 325 that is substantially similar to a target audio output is described below in conjunction with Equations 1-3.

Figure 4:
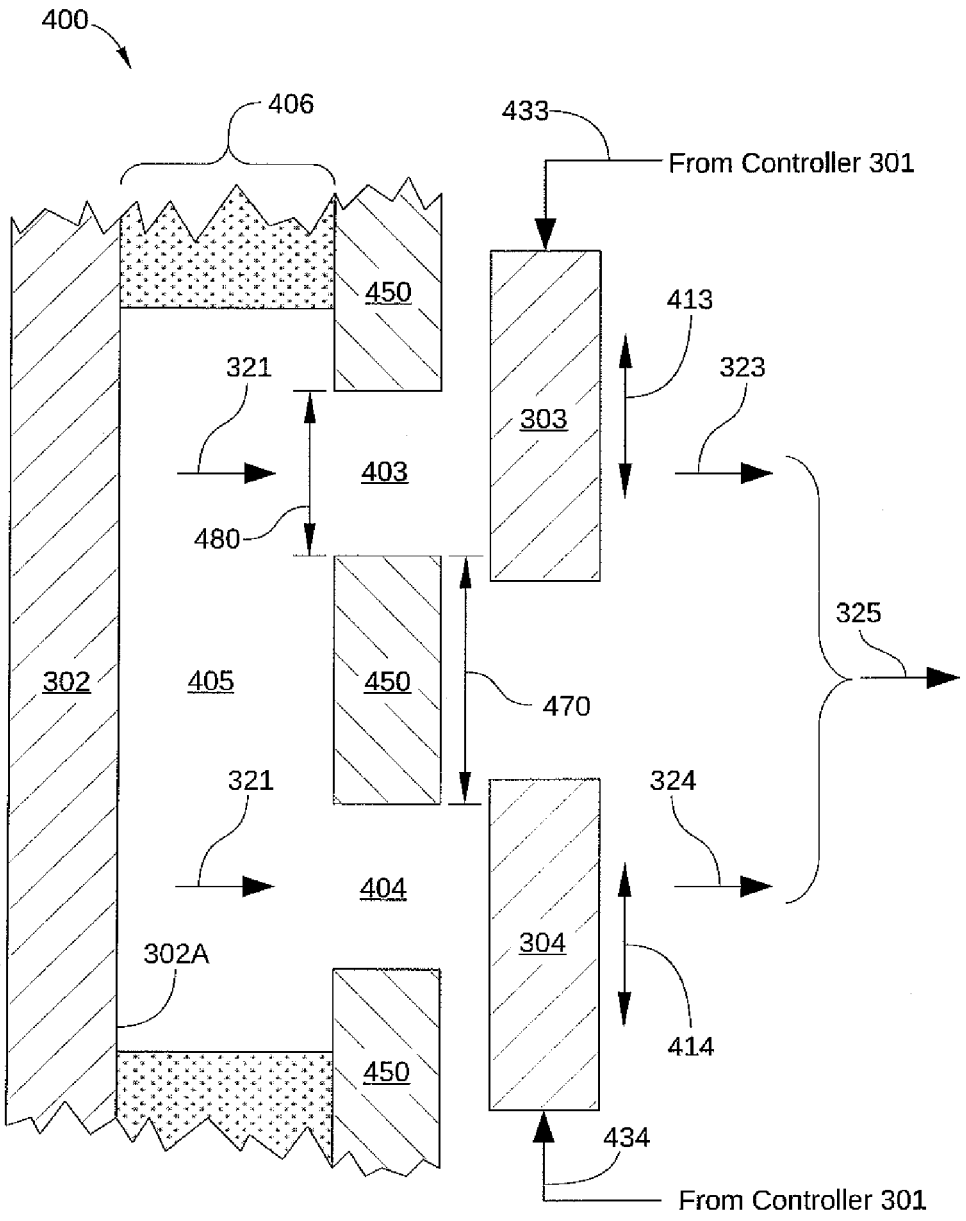
FIG. 4 is a cross-sectional view of an example embodiment of a pico speaker system in which a first MEMS shutter and a second MEMS shutter are each configured to perform amplitude modulation of an ultrasonic carrier signal.

In some embodiments, first MEMS shutter 303 and second MEMS shutter 304 may be configured to implement first modulation signal 333 and second modulation signal 334, respectively, by each independently performing amplitude modulation of ultrasonic acoustic carrier signal 321. One such embodiment is illustrated in FIG. 4. FIG. 4 is a cross-sectional view of an example embodiment of a pico speaker system 400 in which first MEMS shutter 303 and second MEMS shutter 304 are each configured to perform amplitude modulation of ultrasonic carrier signal 321 in accordance with at least some embodiments of the present disclosure. In the embodiment illustrated in FIG. 4, pico speaker system 400 may be realized as a MEMS structure formed from various layers and/or thin films formed on a MEMS substrate. As shown, in some embodiments, ultrasonic carrier signal 321 may be generated into an acoustic pipe 405 by oscillation membrane 302. Acoustic pipe 405 may be formed by the removal of a portion of a sacrificial layer 406 that is formed on the MEMS substrate. A portion of ultrasonic carrier signal 321 may pass from acoustic pipe 405 through a first aperture 403 that is alternately covered and uncovered by first MEMS shutter 303, either partially or completely, where the motion of first MEMS shutter 303 may be defined by first modulation signal 333.

First modulation signal 333 (shown in FIG. 3) may be implemented as a displacement 413 of first MEMS shutter 303 via an appropriate voltage signal 433 applied to first MEMS shutter 303 by controller 301. Similarly, a second portion of ultrasonic carrier signal 321 may pass from acoustic pipe 405 through a second aperture 404 that is alternately covered and uncovered by second MEMS shutter 304, either partially or completely, where the motion of second MEMS shutter 304 may be defined by second modulation signal 334. Second modulation signal 334 (shown in FIG. 3) may be implemented as a displacement 414 of second MEMS shutter 304 via an appropriate voltage signal 434 applied to second MEMS shutter 304 by controller 301 in FIG. 3. Thus first MEMS shutter 303 and second MEMS shutter 304 may be configured to operate independently of each in order to implement first modulation signal 333 and second modulation signal 334, respectively.

By covering and uncovering first aperture 403 with first MEMS shutter 303 and second aperture 404 with second MEMS shutter 304 in the manner described above, ultrasonic carrier signal 321 can be modulated with two different modulation functions. In this way, pico speaker system 400 can generate acoustic signal 323 and acoustic signal 324 as shown. It is noted that the dimensions of pico speaker system 400 can be significantly less than the wavelength of even the highest frequency audible sound waves. Therefore, acoustic signal 323 and acoustic signal 324 may be essentially emitted from the same location acoustically, and may be combined into resultant acoustic signal 325 when generated. Specifically, because pico speaker system 400 is a MEMS-based system, a separation distance 470 between aperture 403 and aperture 404 can be, for example, on the order of 10s or 100s of microns, which is significantly smaller than the approximately 2 cm wavelength of 15 kHz sound. Similarly, a characteristic length 480 of aperture 403 and aperture 404 can also be, for example, on the order of 10s or 100s of microns, where the characteristic length of an aperture may be considered a dimension defining the physical scale of the aperture. For example, for a circular aperture, the diameter of such an aperture may be considered the characteristic length of the aperture; for a square opening, the length of one side may be considered the characteristic length; for a rectangular opening, the length of a diagonal may be considered the characteristic length, and so forth.

In some embodiments, first MEMS shutter 303 and/or second MEMS shutter 304 may be configured to translate in a direction substantially orthogonal to the direction in which ultrasonic carrier signal 321 propagates. In such embodiments, first MEMS shutter 303 and/or second MEMS shutter 304 may be positioned substantially parallel to a primary surface 302A of oscillation membrane 302. In addition, in such embodiments, a MEMS comb drive (not shown) may be used to convert voltage signal 433 into displacement 413 of first MEMS shutter 303 and another MEMS comb drive (not shown) may be used to convert voltage signal 434 into displacement 414 of second MEMS shutter 304. A suitable configuration of a MEMS comb drive may be used for actuating first MEMS shutter 303 and second MEMS shutter 304 in FIG. 4.

Any other type of technically feasible MEMS actuator may also be used to convert voltage signal 433 into displacement 413 of first MEMS shutter 303 and/or to convert voltage signal 434 into displacement 414 of second MEMS shutter 304. For example, any MEMS actuators may be used that 1) can provide sufficient magnitude of displacements 413 and 414 to cover and uncover first aperture 403 and second aperture 404, respectively, and 2) has an operational bandwidth that includes the frequency of ultrasonic carrier signal 321. Furthermore, in some embodiments, the dimensions of first MEMS shutter 303, second MEMS shutter 304, displacement 313, and displacement 314 may be selected such that first aperture 403 and second aperture 404 can be completely covered by first MEMS shutter 303 and second MEMS shutter 304, respectively. In other embodiments, the dimensions of first MEMS shutter 303, second MEMS shutter 304, displacement 313, and displacement 314 may be selected such that first MEMS shutter 303 and second MEMS shutter 304 only partially cover first aperture 403 and second aperture 404, respectively.

In some embodiments, first aperture 403 and second aperture 404 may be formed in a blind element 450 that is disposed between oscillation membrane 302 on one side and first MEMS shutter 303 and second MEMS shutter 304 on the other side. In such embodiments, blind element 450 may be formed from a layer or thin film disposed on the MEMS substrate on which oscillation membrane 302, first MEMS shutter 303, and second MEMS shutter 304 formed. Furthermore, in such embodiments, first aperture 403 may be configured as a plurality of openings formed in blind element 450 that can be substantially covered by first MEMS shutter 303, and second aperture 404 may be configured as a plurality of openings formed in blind element 450 that can be substantially covered by second MEMS shutter 304.

As noted above, by generating a suitable acoustic signal 323 and acoustic signal 324, resultant acoustic signal 325 can be produced that is substantially similar to a target audio output for a pico speaker system and is substantially without a high-band ultrasonic signal. According to embodiments of the disclosure, an acoustic application of the single sideband modulation principle may be used to eliminate a high frequency modulated sideband (for example high frequency modulated sideband 202 in FIG. 2) from resultant acoustic signal 325 in this way. Thus, acoustic energy generated by a pico speaker system may be transferred to the low frequency modulated sideband (for example low frequency modulated sideband 201 in FIG. 2), thereby significantly increasing the efficiency of the pico speaker system, since for a given power the audio amplitude is approximately doubled. To that end, one oscillation element of the pico speaker system (for example first MEMS shutter 303 in FIG. 3) may be configured to modulate an ultrasonic acoustic carrier signal (for example ultrasonic acoustic carrier signal 321) with a first modulation function (implemented, for example, using first modulation signal 333), and another oscillation element of the pico speaker system (for example second MEMS shutter 304 in FIG. 3) may be configured to modulate the ultrasonic acoustic carrier signal by a second modulation function (implemented, for example, using second modulation signal 334), so that acoustic signal 324 is a linear derivation of acoustic signal 323, e.g., the Hilbert transform of acoustic signal 323.

In such embodiments, the first modulation function, referred to herein as A(t), may be based on a target audio signal to be generated by the pico speaker system, and the second modulation function, referred to herein as H(A)(t), may be based on a Hilbert transform of first modulation function A(t). For example, in some embodiments, first modulation function A(t) may include a time-varying acoustic signal that substantially corresponds to the target audio output of the pico speaker system. In some embodiments, first modulation function A(t) may also include additional elements that enhance fidelity of resultant acoustic signal 325 with respect to the target audio output. For example, first modulation function A(t) may include one or more predistortion elements configured to compensate for frequency dependent behavior associated with the pico speaker system. Alternatively or additionally, first modulation function A(t) may include one or more elements to augment one or more bands of the output of the pico speaker system, such as bass or treble.

Second modulation function H(A)(t) may be based on a Hilbert transform of first modulation function A(t). The Hilbert transform of A(t) can be thought of as the convolution of A(t) with the function $h(t)=1/(\pi t)$. Because h(t) is not integrable, the integrals defining the convolution do not converge. Instead, the Hilbert transform may be defined using the Cauchy principal value (denoted herein by p.v.). In some embodiments, the Hilbert transform of a function (or signal) A(t) may be given explicitly by Equation 1:

$$H(A)(t) = p.v.\int_{-\infty}^{\infty} A(\tau)h(t-\tau)\,d\tau = \frac{1}{\pi}p.v.\int_{-\infty}^{\infty}\frac{A(\tau)}{t-\tau}\,d\tau \tag{1}$$

where $A(\tau)$ is the temporal ($\tau$) amplitude of the audio signal and H(A) is the Hilbert transform kernal.

Second modulation function H(A)(t) may be obtained for a particular first modulation function A(t) using a Hilbert transformer. In some embodiments, the Hilbert transformer may be implemented as logic circuitry or a logic module included in controller 301 shown in FIG. 3, such as a digital signal processing module. In some embodiments, an analog-to-digital converter may be used to determine second modulation function H(A)(t). Alternatively, in some embodiments, the Hilbert transformer that determines second modulation function H(A)(t) for a particular first modulation function A(t) may be external to pico speaker system 300. In such embodiments, first modulation function A(t) and second modulation function H(A)(t) may be both provided to controller 301 during operation.

Given first modulation function A(t) and second modulation function H(A)(t), controller 301 can then generate and supply first modulation signal 333 to first MEMS shutter 303 and second modulation signal 334 to second MEMS shutter 304. First modulation signal 333 may be a time-varying voltage signal configured to cause first MEMS shutter 303 to be displaced in a manner described by first modulation function A(t). Similarly, second modulation signal 334 may be a time-varying voltage signal configured to cause second MEMS shutter 304 to be displaced in a manner described by second modulation function H(A)(t).

By way of illustration, modulation of ultrasonic acoustic carrier signal 321 with first modulation function A(t) and second modulation function H(A)(t) is now described in terms of a single tone. In this instance, $A(t)=\sin(\Omega_1 t)$ and $H(A)(t)=\cos(\Omega_1 t)$, where $\Omega_1$ is given by $\Omega_1=2\pi f_1$ and $f_1$ is the frequency of the single tone. In addition, an acoustic signal S(t) generated by pico speaker system 300 can be generally described by the relation $S(t)=\cos(\Omega t)A(t)$, where $\Omega=2\pi f$ and f is the carrier frequency. In this case, when first MEMS shutter 303 is modulated according to first modulation function A(t) and second MEMS shutter 304 is modulated according to second modulation function H(A)(t), the resulting acoustic signal is described by Equation 2:

$$S(t)\cos(\Omega t)*(A(t)+H(A)(t)) \quad (2)$$

Using the first modulation function $\sin(\Omega_1 t)$ for first modulation function A(t) and $\sin(\Omega_1 t)$ for second modulation function H(A)(t) into Equation 2 yields Equation 3:

$$S(t)=\cos(\Omega t)+\sin(\Omega_1 t)+\cos(\Omega t)+\cos(\Omega_1 t) \quad (3)$$

Using the trigonometric identity $\cos(\Omega_1)*\sin(\Omega)=\frac{1}{2}*(\sin(\Omega_1-\Omega)+\sin(\Omega_1+\Omega))$, Equation 3 can be simplified to Equation 4, which indicates that acoustic signal S(t) generated by pico speaker system 300 does not include a high band ultrasound signal. Thus, the efficiency of pico speaker system 300 is improved.

$$S(t)=\sin((\Omega-\Omega_1)t) \quad (4)$$

In some embodiments, modulation of an ultrasonic acoustic carrier signal by first modulation function A(t) and second modulation function H(A)(t) may be performed using frequency modulation rather than amplitude modulation. In such embodiments, a beat frequency may be used to implement first modulation function A(t) and second modulation function H(A)(t). The beat frequency for modulating the ultrasonic carrier signal by first modulation function A(t) may be generated using a difference in frequency between the ultrasonic carrier signal and a first modulating device of a pico speaker system (such as a MEMS-shutter). Similarly, the beat frequency for modulating the ultrasonic carrier signal by second modulation function H(A)(t) may be generated using a difference in frequency between the ultrasonic carrier signal and a second modulating device of the pico speaker system.

In some embodiments, modulation of an ultrasonic acoustic carrier signal by first modulation function A(t) and second modulation function H(A)(t) may be performed with a pico speaker system that is configured differently than pico speaker system 300. For example, in some embodiments, a pico speaker system may include two oscillation elements, such as MEMS oscillation membranes or piezoelectric transducers, and a single MEMS shutter element that can be configured to modulate the output of each of the two oscillation elements in the same way. In such embodiments, the first oscillation element may be configured to oscillate based on a first modulation function, such as first modulation function A(t), to generate a first ultrasonic acoustic signal. The second oscillation element may be configured to oscillate based on a second modulation function, such as second modulation function H(A)(t), to generate a second ultrasonic acoustic signal. The single MEMS shutter element may then modulate both the first ultrasonic acoustic signal and the second ultrasonic acoustic signal in the same way, for example by superimposing a carrier frequency onto each. One such embodiment is illustrated in FIG. 5.

Figure 5:
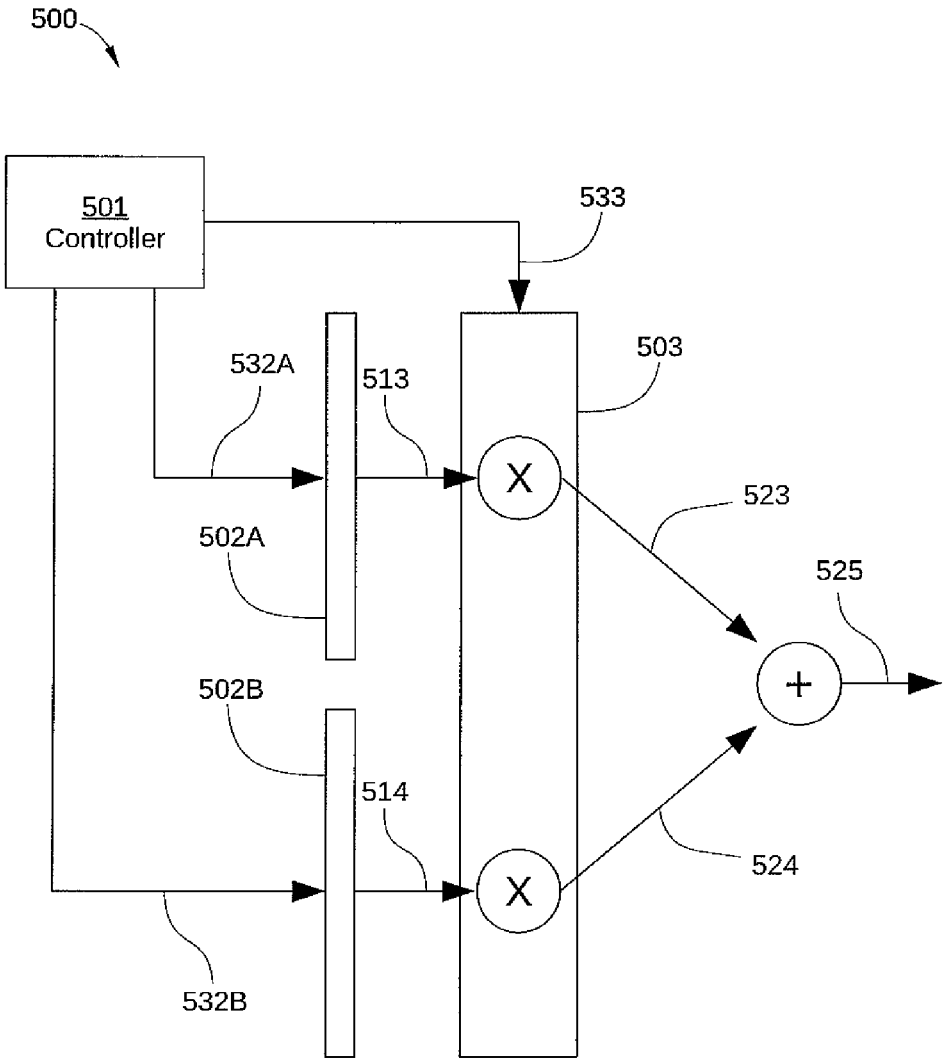
FIG. 5 is a block diagram illustrating a pico speaker system.

FIG. 5 is a block diagram illustrating a pico speaker system 500, arranged in accordance with at least some embodiments of the present disclosure. Pico speaker system 500 may be substantially similar in configuration and operation to pico speaker system 300 in FIG. 3, except that pico speaker system 500 may include two independently operating oscillation membranes (oscillation membrane 502A and oscillation membrane 502B) and a single MEMS shutter 503, rather than one oscillation membrane and two independently operating MEMS shutters, as illustrated in FIG. 3 with pico speaker system 300.

Oscillation membrane 502A and oscillation membrane 502B may each be similar to oscillation membrane 302 in FIG. 3 and may be arranged as shown in FIG. 5. In embodiments in which oscillation membrane 502A and oscillation membrane 502B are configured as MEMS oscillation membranes, oscillation membrane 502A and oscillation membrane 502B may be formed from the same layer or thin film disposed on a MEMS substrate. Oscillation membrane 502A may be configured to generate an acoustic signal 513 in response to receiving a first modulation signal 532A from a controller 501 that is associated with pico speaker system 500, and oscillation membrane 502B may be configured to generate an acoustic signal 514 in response to receiving a second modulation signal 532B from controller 501.

In some embodiments, first modulation signal 532A may be based on first modulation function A(t) and second modulation signal 5326 may be based on second modulation function H(A)(t). MEMS shutter 503 can be configured to modulate both acoustic signal 513 and acoustic signal 514 in response to receiving a modulation signal 533 from controller 501. In this way, modulation signal 533 can be selected to induce displacement over time, such as periodic displacement, of MEMS shutter 503 to modulate acoustic signal 513 and acoustic signal 514 with an acoustic carrier signal having a frequency of Ω. Consequently, an acoustic signal 523 is generated from such modulation of acoustic signal 513, and an acoustic signal 524 is generated from such modulation of acoustic signal 514. Because acoustic signal 513 is generated based on first modulation function A(t) and acoustic signal 514 may be generated based on second modulation function H(A)(t), a resultant acoustic signal 525 is produced by pico speaker system 500 that is 1) substantially similar to a target audio output for pico speaker system 500 and 2) substantially without a high-band ultrasonic signal. As noted previously, first modulation function A(t) may include a time-varying acoustic signal that substantially corresponds to a target audio output for pico speaker system 500, and second modulation function H(A)(t) may be based on a Hilbert transform of first modulation function A(t).

In some embodiments, first modulation function A(t) and second modulation function H(A)(t) may be implemented by the movement of modulators substantially perpendicular to the general direction of propagation of acoustic signals 513 and 514, and in other embodiments by the movement of modulators substantially parallel to the general direction of propagation of acoustic signals 513 and 514. An example of one of the latter embodiments is illustrated in FIG. 6.

Figure 6:
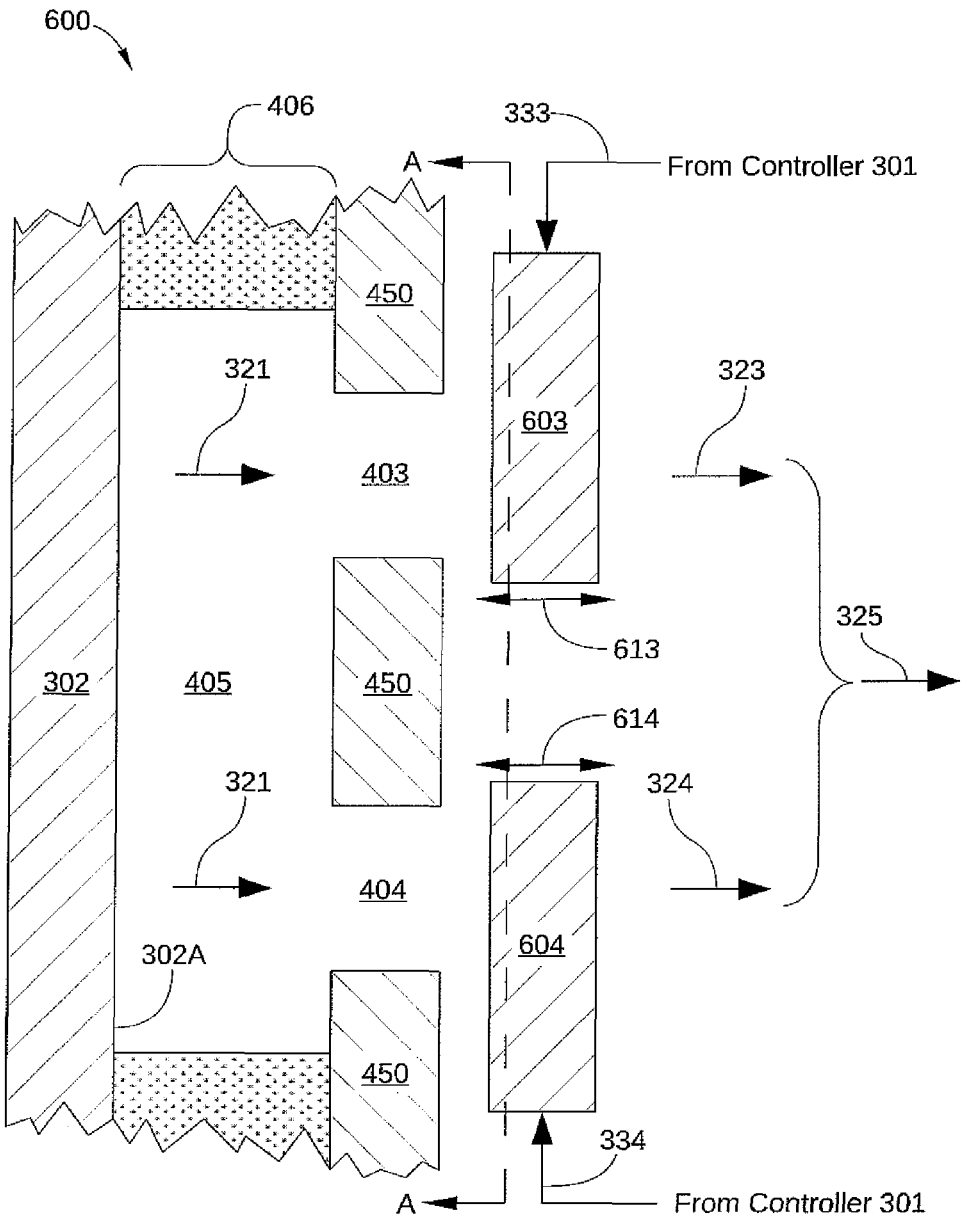
FIG. 6 is a cross-sectional view of a pico speaker system.

FIG. 6 is a cross-sectional view of a pico speaker system 600, arranged in accordance with at least some embodiments of the present disclosure. Pico speaker system 600 may be substantially similar in configuration and operation to pico speaker system 400 in FIG. 4, except that pico speaker system 600 may include at least one MEMS shutter that is configured to translate in a direction substantially parallel to the direction in which an ultrasonic carrier signal generated by an oscillation membrane propagates. In contrast, pico speaker system 400 includes MEMS shutters that are configured to translate in a direction substantially orthogonal to the direction in which an ultrasonic carrier signal is generated.

For example, in the embodiment illustrated in FIG. 6, pico speaker system 600 includes MEMS shutter 603 and MEMS shutter 604, each of which is configured to translate in a direction substantially parallel to ultrasonic acoustic carrier signal 321. In this way, MEMS shutter 603 is configured to undergo a time-varying displacement 613 in response to first modulation signal 333, and MEMS shutter 604 is configured to undergo a time-varying displacement 614 in response to second modulation signal 334.

In pico speaker system 600, the time-varying displacement of MEMS shutter 603 may modulate the amplitude of one portion of ultrasonic acoustic carrier signal 321 to generate acoustic signal 323, while the time-varying displacement of MEMS shutter 604 may modulate the amplitude of another portion of ultrasonic acoustic carrier signal 321 to generate acoustic signal 324. This modulation occurs because movement toward first aperture 403 by MEMS shutter 603 and movement toward second aperture 404 by MEMS shutter 604 substantially obscures or covers first aperture 403 and second aperture 404, respectively, while movement away from first aperture 403 by MEMS shutter 603 and movement away from second aperture 404 by MEMS shutter 604 substantially uncovers first aperture 403 and second aperture 404, respectively.

In comparison with pico speaker system 400 in FIG. 4, the amplitude modulation of ultrasonic acoustic carrier signal 321 in pico speaker system 600 may provide enhanced modulation depth and may implement substantially less surface area of a MEMS substrate to be manufactured. This is because there is no need for a comb drive or other external mechanical actuator to translate MEMS shutter 603 with time-varying displacement 613 or MEMS shutter 604 with time-varying displacement 614. Instead, MEMS shutter 603 and MEMS shutter 604 can each be configured as an electrostatic actuator, where an electrical voltage between a MEMS shutter and blind element 450 causes the MEMS shutter to move relative to bind element 450. Thus, when an electrical bias is applied to a MEMS shutter (e.g., MEMS shutter 603) while blind element 450 is electrically grounded to provide a reference for the electric field, the shutter is pulled toward blind element 450 and substantially blocks an opening formed in blind element 450 that is aligned with the MEMS shutter (e.g., aperture 403). Furthermore, each MEMS shutter can be configured with a spring structure, so that when the MEMS shutter is pulled towards an aperture in response to the application of a bias to the MEMS shutter, the spring is in tension, and when the bias is reduced or reversed in polarity, the spring tension pulls the MEMS shutter away from the aperture. One embodiment of such a configuration of MEMS shutter 603 and MEMS shutter 604 is illustrated in FIG. 7.

Figure 7:
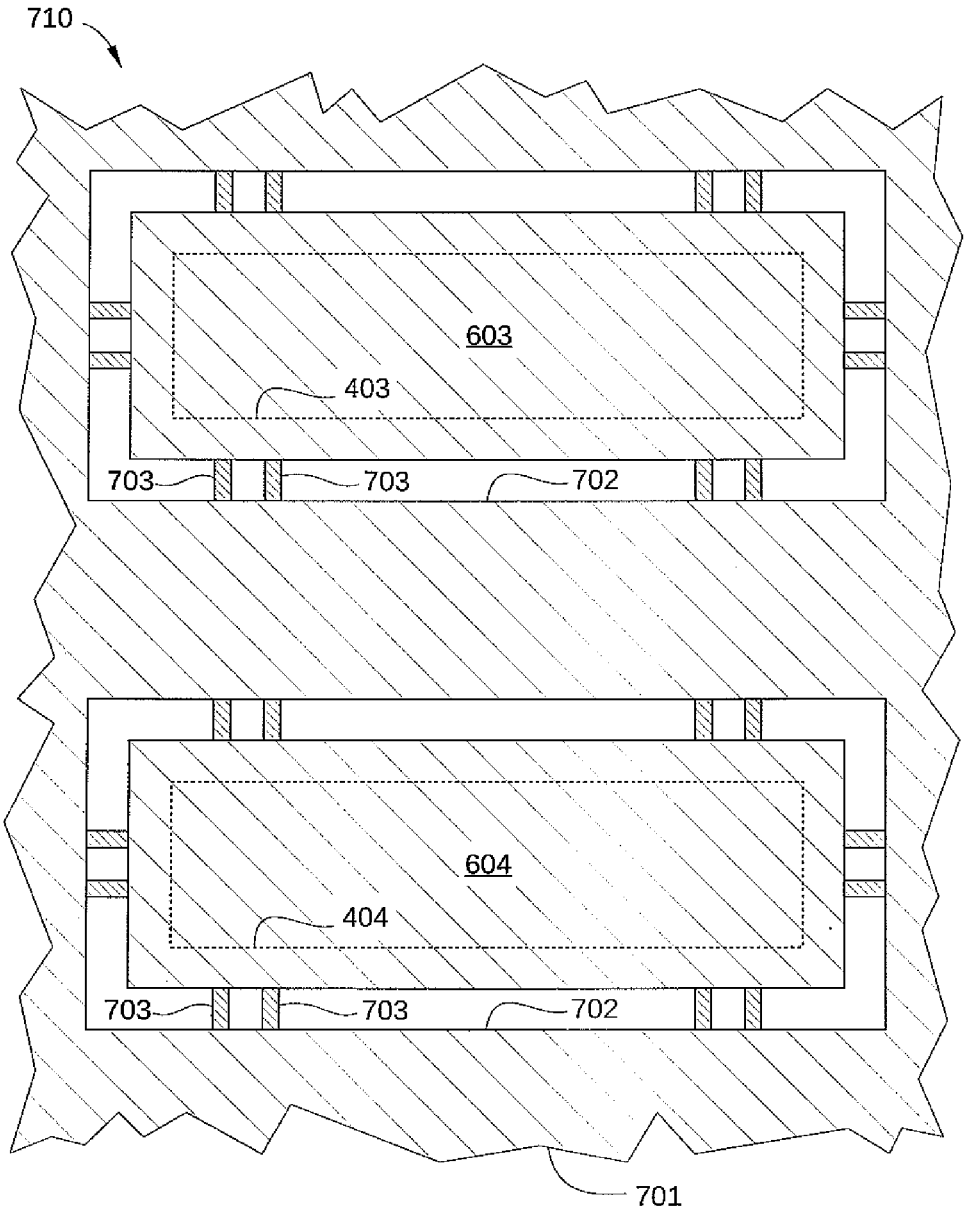
FIG. 7 is a schematic cross-sectional diagram illustrating one configuration of two MEMS shutters.

FIG. 7 is a schematic cross-sectional diagram illustrating one configuration of MEMS shutter 603 and MEMS shutter 604, arranged in accordance with at least some embodiments of the present disclosure. The cross-section depicted in FIG. 7 is taken at section A-A in FIG. 6. For reference, the locations of aperture 403 and aperture 404 relative to MEMS shutter 603 and MEMS shutter 604 are indicated with dashed lines. MEMS shutter 603 and MEMS shutter 604 may be formed from portions of a single layer 701 of a MEMS substrate 710. For example, in some embodiments, layer 701 may be a silicon layer. As shown, MEMS shutter 603 and MEMS shutter 604 may be formed in frame 702 using micromachining techniques, where frame 702 may be part of a bulk portion of layer 701. In addition, MEMS shutter 603 and MEMS shutter 604 may be mechanically coupled to frame 702 via spring elements 703, which may also be formed from layer 701. Spring elements 703 may provide tension resisting movement of MEMS shutter 603 and MEMS shutter 604 out of the plane of layer 701, e.g., when MEMS shutter 603 and MEMS shutter 604 translate toward or away from aperture 403 and 404, respectively. In some embodiments, spring elements 703 may be configured to allow movement in and out of the plane of layer 701. Such movement may be on the order of less than 1 micron and as much as several microns, depending on what frequency is targeted for MEMS shutter 603 and MEMS shutter 604. For example, using micromachining techniques, MEMS shutter 603 and MEMS shutter 604 may be configured to oscillate at up to about 150 Khz. Specific dimensions of spring elements 703 that enable oscillation at a particular frequency may depend on a number of factors, including thickness and material properties of layer 701, mass of MEMS shutter 603 and MEMS shutter 604, bias applied to MEMS shutter 603 and MEMS shutter 604, target magnitude of displacement 613 and displacement 614, and/or other factors. Given at least some of these factors, spring elements 703 that enable oscillation of MEMS shutter 603 and MEMS shutter 604 at a particular frequency, for example frequencies in the range of 50 to 300 kHz can be configured. Potential springs for this frequency range may include silicon cantilevers having a length of 10-100 microns, a width of 10-20 microns and thickness of 1-10 microns.

In one embodiment, at least two independent membranes and two modulating shutters may be used to generate two different acoustic signals. When combined, the two different acoustic signals may generate target acoustic signal A(t). In such an embodiment, a first oscillation membrane is driven with $A(t)\cos(\Omega_1 t)$ and a second oscillation membrane is driven by $A(t)\,\mathrm{Sin}(\Omega_1 t)$, while a first MEMS shutter element is driven by $\mathrm{Cos}(\Omega_1 t)$ and a second MEMS shutter element is driven by $\mathrm{Sin}(\Omega_1 t)$. The resulting acoustic signal is given by the sum of both signals at the output of the MEM-based audio speaker and can be written as $A(t)[\cos^2(\Omega_1 t)+\sin^2(\Omega_1 t)]=A(t)$.

In some embodiments, a MEMS-based audio speaker system may be configured with multiple speaker devices that modulate an ultrasonic signal to generate a target audio signal that has an acoustic directionality associated therewith that is controllable based on the modulation of the ultrasonic signal. In other words, a direction in which the target audio signal propagates from the MEMS-based audio speaker system can be selected based on how the ultrasonic signal is modulated by different speaker devices in the MEMS-based audio speaker system. In such embodiments, the multiple speaker devices can be configured as an acoustic phased array.

In embodiments in which a MEMS-based audio speaker system, such as pico speaker system 300, is configured to operate as an acoustic phased array, the relative phases of respective acoustic signals being generated by different speaker devices may be varied in such a way that the effective pattern of acoustic propagation from the MEMS-based audio speaker system is reinforced in a particular direction and suppressed in other directions. In the case of pico speaker system 300 in FIG. 3, controller 301 may be configured to control the direction in which resultant acoustic signal 325 propagates by offsetting a phase of acoustic signal 323 relative to a phase of acoustic signal 324 and/or by altering an amplitude of acoustic signal 323 relative to an amplitude of acoustic signal 324. In this way, the acoustic directionality of resultant acoustic signal 325 can be significantly altered from the direction of propagation of ultrasonic acoustic carrier signal 321, and may be determined by the combination of acoustic signal 323 and acoustic signal 324. Such directionality of resultant acoustic signal 325 may be produced via a pattern of constructive and destructive interference in the resultant audio signal.

While a MEMS-based audio speaker system having only two speaker devices may be configured as a phased array as described above, greater directionality can be achieved with more speaker devices and/or with speaker devices that are positioned farther apart. In some embodiments, a MEMS-based audio speaker system may include a large number of speaker devices similar to those described herein. Because such speaker devices may have a very small form factor (for example on the order of a few hundred microns), a large number of such speaker devices may be formed on a relatively small surface, such as a 2 mm×2 mm or 3 mm×3 mm silicon chip. Such a MEMS-based audio speaker array may be configured with 10s or 100s or other numbers of such speaker devices, thereby facilitating the use of such a speaker array as an acoustic phased array.

Figure 8:
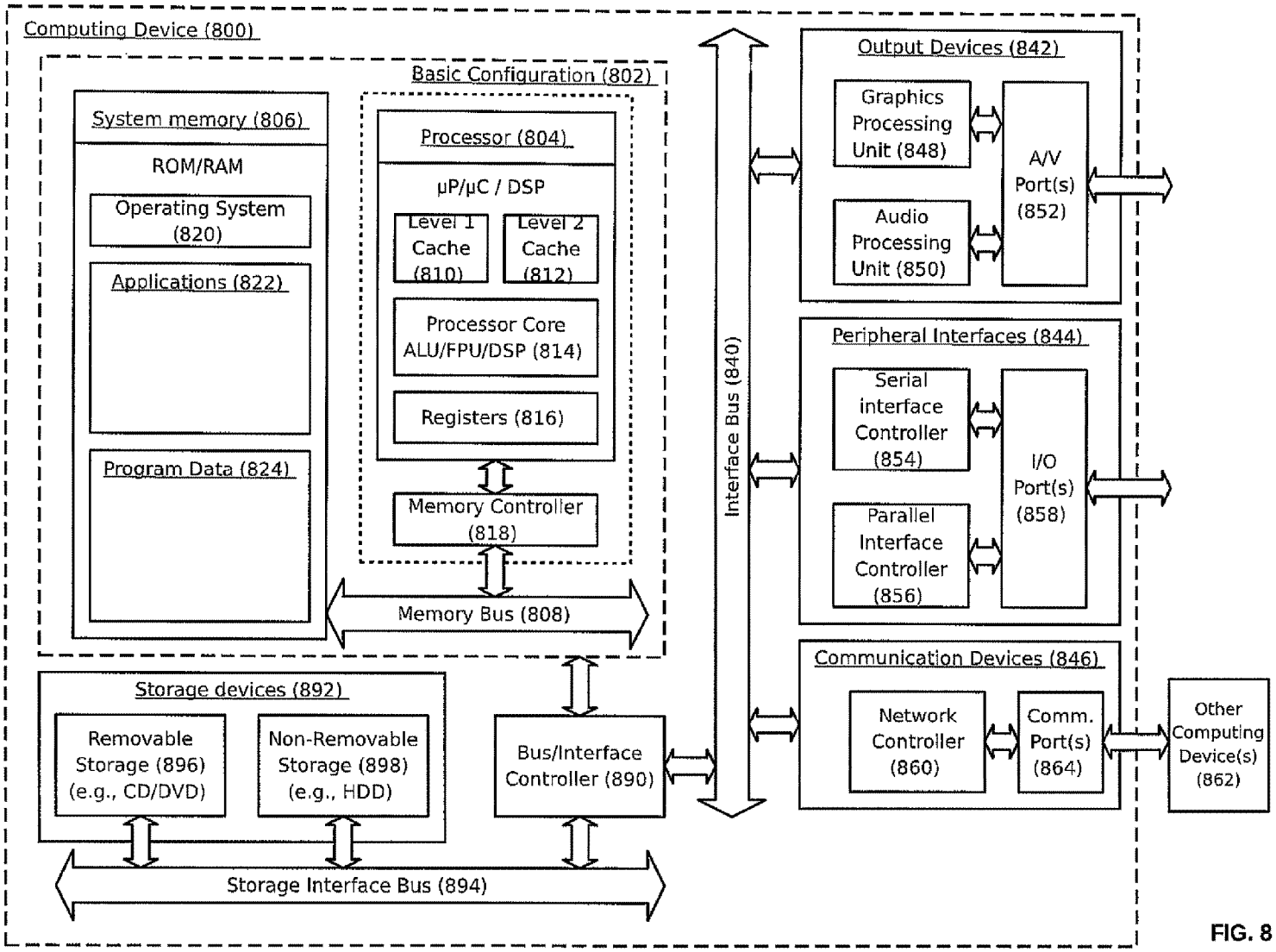
FIG. 8 is a block diagram illustrating an example computing device 800 that is arranged to generate an acoustic signal, all arranged in accordance with at least some embodiments of the present disclosure.

FIG. 8 is a block diagram illustrating an example computing device 800 that is arranged to generate an acoustic signal, in accordance with at least some embodiments of the present disclosure. In a very basic configuration 802, computing device 800 typically includes one or more processors 804 and a system memory 806. A memory bus 808 may be used for communicating between processor 804 and system memory 806.

Depending on the desired configuration, processor 804 may be of any type including but not limited to a microprocessor (μP), a microcontroller (μC), a digital signal processor (DSP), or any combination thereof. Processor 804 may include one more levels of caching, such as a level one cache 810 and a level two cache 812, a processor core 814, and registers 816. An example processor core 814 may include an arithmetic logic unit (ALU), a floating point unit (FPU), a digital signal processing core (DSP Core), or any combination thereof. Processor 804 may include programmable logic circuits, such as, without limitation, field-programmable gate arrays (FPGAs), patchable application-specific integrated circuits (ASICs), complex programmable logic devices (CPLDs), and others. An example memory controller 818 may also be used with processor 804, or in some implementations memory controller 818 may be an internal part of processor 804.

Depending on the desired configuration, system memory 806 may be of any type including but not limited to volatile memory (such as RAM), non-volatile memory (such as ROM, flash memory, etc.) or any combination thereof. System memory 806 may include an operating system 820, one or more applications 822, and program data 824. Program data 824 may include data that may be useful for operation of computing device 800. In some embodiments, application 822 may be arranged to operate with program data 824 on operating system 820. This described basic configuration 802 is illustrated in FIG. 8 by those components within the inner dashed line.

Computing device 800 may have additional features or functionality, and additional interfaces to facilitate communications between basic configuration 802 and any required devices and interfaces. For example, a bus/interface controller 890 may be used to facilitate communications between basic configuration 802 and one or more data storage devices 892 via a storage interface bus 894. Data storage devices 892 may be removable storage devices 896, non-removable storage devices 898, or a combination thereof. Examples of removable storage and non-removable storage devices include magnetic disk devices such as flexible disk drives and hard-disk drives (HDDs), optical disk drives such as compact disk (CD) drives or digital versatile disk (DVD) drives, solid state drives (SSDs), and tape drives to name a few. Example computer storage media may include volatile and nonvolatile, removable and non-removable media implemented in any method or technology for storage of information, such as computer readable instructions, data structures, program modules, or other data.

System memory 806, removable storage devices 896 and non-removable storage devices 898 are examples of computer storage media. Computer storage media includes, but is not limited to, RAM, ROM, EEPROM, flash memory or other memory technology, CD-ROM, digital versatile disks (DVDs) or other optical storage, magnetic cassettes, magnetic tape, magnetic disk storage or other magnetic storage devices, or any other medium which may be used to store the desired information and which may be accessed by computing device 800. Any such computer storage media may be part of computing device 800.

Computing device 800 may also include an interface bus 840 for facilitating communication from various interface devices (e.g., output devices 842, peripheral interfaces 844, and communication devices 846) to basic configuration 802 via bus/interface controller 890. Example output devices 842 include a graphics processing unit 848 and an audio processing unit 850, which may be configured to communicate to various external devices such as a display or speakers via one or more A/V ports 852. Such speakers may include one or more embodiments of pico speaker systems as described herein. Example peripheral interfaces 844 include a serial interface controller 854 or a parallel interface controller 856, which may be configured to communicate with external devices such as input devices (e.g., keyboard, mouse, pen, voice input device, touch input device, etc.) or other peripheral devices (e.g., printer, scanner, etc.) via one or more I/O ports 858. An example communication device 846 includes a network controller 860, which may be arranged to facilitate communications with one or more other computing devices 862 over a network communication link, such as, without limitation, optical fiber, Long Term Evolution (LTE), 3G, WiMax, via one or more communication ports 864.

The network communication link may be one example of a communication media. Communication media may typically be embodied by computer readable instructions, data structures, program modules, or other data in a modulated data signal, such as a carrier wave or other transport mechanism, and may include any information delivery media. A "modulated data signal" may be a signal that has one or more of its characteristics set or changed in such a manner as to encode information in the signal. By way of example, and not limitation, communication media may include wired media such as a wired network or direct-wired connection, and wireless media such as acoustic, radio frequency (RF), microwave, infrared (IR) and other wireless media. The term computer readable media as used herein may include both storage media and communication media.

Computing device 800 may be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. Computing device 800 may also be implemented as a personal computer including both laptop computer and non-laptop computer configurations.

As described herein, embodiments of the present disclosure include a MEMS-based audio speaker system configurable with multiple speaker devices. A MEMS-based shutter element in a first speaker device of the audio speaker system may be configured to modulate an ultrasonic signal to generate a first acoustic signal and a MEMS-based shutter element in a second speaker device of the audio speaker system may be configured to modulate the ultrasonic signal to generate a second acoustic signal that is a different acoustic signal than the first acoustic signal. When the MEMS-based shutter element in the first speaker device modulates the ultrasonic signal based on a modulation function and the MEMS-based shutter element in the second speaker device modulates the ultrasonic signal based on a Hilbert transform of the modulation function, the MEMS-based audio speaker system can generate a target audio signal that is substantially without a high-band ultrasonic signal.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

I claim:

1. A speaker apparatus, comprising:

a first speaker device that comprises:

a first oscillation element configured to generate a first ultrasonic acoustic signal along a first directional path; and a second oscillation element configured to modulate the first ultrasonic acoustic signal such that a first acoustic signal is generated; and a second speaker device that comprises:

a third oscillation element configured to generate a second ultrasonic acoustic signal along the first directional path; and a fourth oscillation element configured to modulate the second ultrasonic acoustic signal such that a second acoustic signal is generated, wherein the second acoustic signal is a linear derivation of the first acoustic signal and is a different acoustic signal than the first acoustic signal, and wherein the first speaker device and the second speaker device are each contained in a volume with at least one dimension of unit smaller than a wavelength of the first ultrasonic acoustic signal.

2. The speaker apparatus of claim 1, wherein the fourth oscillation element is configured to modulate the second ultrasonic acoustic signal so that the second acoustic signal is a Hilbert transform of the first acoustic signal.

3. The speaker apparatus of claim 2, wherein a combination of the first acoustic signal and the second acoustic signal produces a resultant acoustic signal that is substantially absent of a high-band ultrasonic signal.

4. The speaker apparatus of claim 1, further comprising a controller configured to generate or control generation of the first acoustic signal and the second acoustic signal such that a combination of the first acoustic signal and the second acoustic signal produces a resultant acoustic signal, wherein the resultant acoustic signal has an acoustic directionality associated therewith that is different from the first directional path.

5. The speaker apparatus of cl aim 4, wherein the controller is configured to offset a phase of the first acoustic signal relative to a phase of the second acoustic signal and to alter an amplitude of the first acoustic signal relative to an amplitude of the second acoustic signal to generate the acoustic directionality of the resultant acoustic signal.

6. The speaker apparatus of claim 5, wherein the controller is configured to generate the acoustic directionality via a pattern of constructive and destructive interference in the resultant acoustic signal.

7. The speaker apparatus of claim 1, wherein the first oscillation element comprises a membrane that is configured to remain substantially stationary with respect to adjacent elements of the first speaker device.

8. The speaker apparatus of claim 7, wherein the first oscillation element and the third oscillation element include the membrane, and wherein the first ultrasonic acoustic signal and the second ultrasonic acoustic signal are a same ultrasonic acoustic signal.

9. The speaker apparatus of claim 7, wherein the first ultrasonic acoustic signal and the second ultrasonic acoustic signal comprise an ultrasonic acoustic carrier signal.

10. The speaker apparatus of claim 7, wherein the second oscillation element is configured to be oscillated by use of a modulation function based on a target audio signal, and wherein the fourth oscillation element is configured to be oscillated by use of a Hilbert transform of the modulation function.

11. The speaker apparatus of claim 7, wherein the second oscillation element comprises a shutter that is configured to translate in a direction orthogonal to the first directional path, and wherein the fourth oscillation element comprises a different shutter that is configured to translate in a direction orthogonal to the first directional path.

12. The speaker apparatus of claim 7, wherein the second oscillation element comprises a shutter that is configured to translate in a direction substantially parallel to the first directional path.

13. The speaker apparatus of claim 12, wherein the second oscillation element is configured without an external mechanical actuator.

14. The speaker apparatus of claim 13, wherein the second oscillation element is coupled to a frame via one or more spring elements.

15. The speaker apparatus of claim 1, wherein the second oscillation element comprises a shutter that is configured to translate in a direction orthogonal to the first directional path.

16. The speaker apparatus of claim 15, wherein the second oscillation element comprises a comb drive.

17. The speaker apparatus of claim 15, wherein the shutter is configured to cover an opening positioned to receive the first ultrasonic acoustic signal to modulate the first ultrasonic acoustic signal.

18. The speaker apparatus of claim 17, wherein the opening is formed in a blind element that is disposed between the first oscillation element and the shutter.

19. The speaker apparatus of claim 15, wherein the shutter is positioned substantially parallel to a primary surface of the first oscillation element.

20. The speaker apparatus of claim 15, wherein the fourth oscillation element comprises a different shutter that is configured to translate in a direction orthogonal to the first directional path.

21. The speaker apparatus of claim 1, wherein one of of the second oscillation element and the fourth oscillation element comprise a shutter that is configured to translate in a direction orthogonal to the first directional path.

22. The speaker apparatus of claim 21, wherein the first oscillation element comprises a first membrane that is configured to remain substantially stationary with respect to adjacent elements of the first speaker device, and wherein the third oscillation element comprises a second membrane that is configured to remain substantially stationary with respect to adjacent elements of the first speaker device.

23. The speaker apparatus of claim 22, wherein the first oscillation element is configured to generate the first ultrasonic acoustic signal based on a modulation function, and wherein the second oscillation element is configured to generate the second ultrasonic acoustic signal based on a Hilbert transform of the modulation function.

24. The speaker apparatus of claim 1, wherein a frequency of the first acoustic signal is equal to a difference between a frequency of the first ultrasonic acoustic signal and a frequency of oscillation of the second oscillation element.

25. A method to generate an acoustic signal with a microelectromechanical system (MEMS) structure-based audio speaker that includes a first speaker device and a second speaker device which are configured to emit the acoustic signal from a same location, the method comprising: displacing an oscillation element of the first speaker device by use of a first modulation function to generate a first acoustic signal; and displacing an oscillation element of the second speaker device by use of a second modulation function to generate a second acoustic signal, wherein the second modulation function comprises a Hilbert transform of the first modulation function; generating an ultrasonic acoustic signal that is directed toward the oscillation element of the first speaker device and the oscillation element of the second speaker device; and wherein the first speaker device and the second speaker device are each contained in a volume with at least one dimension of unit smaller than a wavelength of the first ultrasonic acoustic signal.

26. The method of claim 25, wherein generating the ultrasonic acoustic signal comprises generating the ultrasonic acoustic signal with a MEMS oscillation membrane.

* * * * *